United States Patent [19]

Orizio

[11] 3,987,647

[45] Oct. 26, 1976

[54] PATTERN DRUM

[76] Inventor: Paolo Orizio, via Gioberti 59, Brescia (BS), Italy

[22] Filed: June 30, 1975

[21] Appl. No.: 591,398

[30] Foreign Application Priority Data

July 2, 1974 Italy ..... 5154/74

[52] U.S. Cl. ..... 66/50 B; 66/156

[51] Int. Cl.[2] ..... D04B 15/74

[58] Field of Search ..... 66/50 B, 50 A, 154 R, 66/156

[56] References Cited

UNITED STATES PATENTS

| | | | |
|---|---|---|---|
| 1,940,598 | 12/1933 | Larkin | 66/50 B |
| 2,805,563 | 9/1957 | Brewer et al. | 66/50 B X |
| 3,010,298 | 11/1961 | Schmidt | 66/50 A |
| 3,224,227 | 12/1965 | Beckenstein | 66/50 A |
| 3,298,202 | 1/1967 | Philip | 66/50 A |
| 3,788,101 | 1/1974 | Orizio | 66/50 A |

*Primary Examiner*—Mervin Stein
*Assistant Examiner*—Andrew M. Falik

[57] ABSTRACT

The pattern drum for circular knitting and hosiery machines comprises a tubular body with stacks of discs at each end and a plurality of leaf-like fingers slidable along grooves for the positioning thereof at predetermined places so that changes in patterns may be had without either disassembling the machine or discarding pattern toothed elements.

6 Claims, 6 Drawing Figures

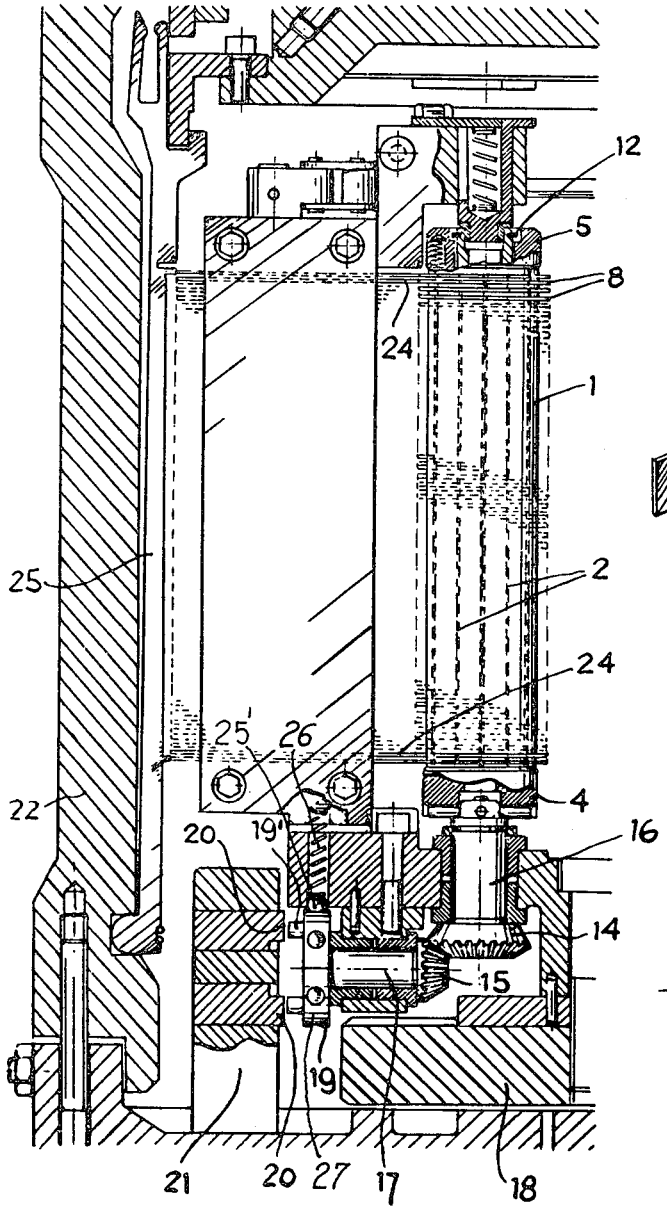
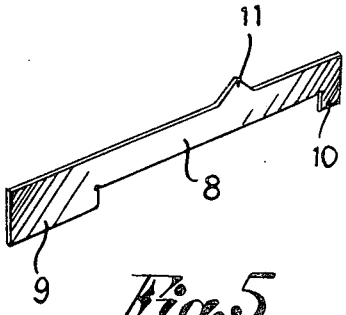
Fig. 5
Fig. 6
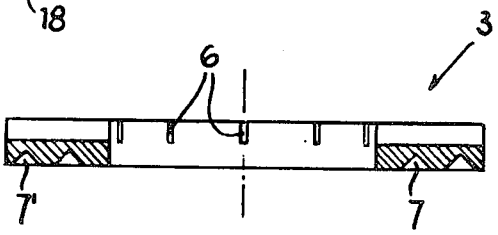
Fig. 4

PATTERN DRUM

FIELD OF THE INVENTION

The present invention relates to pattern disc or drum of circular machines for knitting and for making hosiery articles.

The Prior Art

Among the known and herebefore used pattern drums, employed in knitting and hosiery circular machines for the purpose of knitting a predetermined pattern into the knitted fabric, are those which comprise a cylindrical body on which there are provided numerous longitudinal grooves, radially spaced from one another, in which grooves are inserted mating lath-like strips throughout the entire length of the cylindrical body. These lath-like strips are provided, in turn, with teeth which protrude with respect to the surface of the cylindrical body. The teeth are left in position or removed in accordance with the working pattern and program of the needles of the circular machine required to obtain the predetermined design or pattern.

Also known is another type of pattern drum or pattern disc which consists of a monolithic cylindrical body which has on its lateral surface a plurality of rows of radial holes into which are inserted, manually and in accordance with a predetermined pattern, a number of radial pins which act upon the corresponding sliding elements of the jacks that conventionally actuate or deactuate the needles of the circular machine in accordance with known mechanical operations, so as to obtain a knitted article with the desired pattern or design.

Reference is also made to another pattern disc for knitting machines are described in U.S. Pat. No. 3,788,101 issued on Jan. 29, 1974 to the present inventor. In this patent, which is incorporated for reference, the cooperation of the jacks with the needles and with the other elements of the pattern disc are clearly described.

All of the known and above-mentioned pattern drums are operable but present the serious disadvantage of being expensive from a structural viewpoint and from an operational viewpoint as well. Considerable time and labor are lost or wasted each time it is rendered necessary to vary the operation of the needles for knitting a different design or pattern from that programmed on the pattern drum or disc. Such losses in time and labor, reflecting on the economy of the entire operation, are multiplied with an increase in the number of pattern drums or discs mounted on the machine, as it is the case with knitting circular machines having a cylinder or drum of large diameter, on which as many as 72 pattern drums or discs, one for each feed station, may be mounted.

As a matter of fact, in the case of a pattern drum with lath-like strips, each time there is need for changing the design, it is necessary to remove all the strips from the drum or replace them with other strips with teeth positioned in such a way as to correspond to the new pattern to be knitted. Furthermore, the removed lath-like strips are permanently discarded because it is difficult to re-use them in the formation of other patterns, since the missing teeth on the strips limit the possibilities of combining these strips with other ones so as to obtain the desired pattern or design.

In the case of a pattern drum or disc with insertable pins, when it is required to change a design pattern, it is also necessary to remove the pins one at a time and reinsert them in different holes so as to conform to the new design. Such an operation is evidently considerably lengthy and time consuming and overall costly in that it necessitates a lengthy shut-down of the machine during design alterations.

BRIEF DESCRIPTION OF THE INVENTION

It is therefore an object of the present invention to provide a pattern design drum suitable for circular machines for knitting and hosiery, which drum permits a rapid installation of the means controlling the execution of a predetermined design without necessity of removal of such control means during the alteration of the design pattern.

Another object of the invention is to provide a pattern drum wherein the design pattern may be rapidly varied simply by displacing, without removing them, a number of plate-like or leaf-like fingers which are radially movable and blocked between a plurality of superimposed discs.

A further object of the invention is to provide a pattern drum wherein the variation in the design pattern on the drum may be executed even automatically and rapidly and with reliable precision by means of appropriate mechanism.

These and other objects and advantages of the invention may be effected with the present inprovement which, briefly stated, comprises a pattern drum having a tubular or cylindrical body with longitudinal grooves thereon radially spaced from one another, a plurality of discs stacked one on top of another at each extremity of said tubular body and blocked thereto by terminal fasteners, such as ferrules attached to the body. Each disc has a plurality of radial slots on one surface thereof, the number of slots corresponding to the number of longitudinal grooves in the tubular body. A plurality of plate-like or leaf-like fingers completes the device, these fingers being positioned in said slots, one finger to a slot, and being operationally active or inactive depending on the requirements of the design pattern. The leaf-like fingers preferably have two terminal projections to define the limits of said operationally active and inactive positions and a third, intermediate projection which engages the respective slot of the adjacent disc so as to fix the finger into the preselected position.

The Drawings

A detailed structural description of the improvement of the invention will become apparent from the following paragraphs taken in conjunction with the illustrative and non-limitative accompanying drawings, in which:

FIGS. 3 and 4 are perspective and, respectively, sectional views of a disc with radial slots;

FIG. 5 is a perspective view of a radial leaf-like finger; and

FIG. 6 is a partially sectional view of the pattern drum mounted on a conventional circular knitting machine and showing the necessary conventional means for its operation.

Detail Description of the Invention

Figure 1:
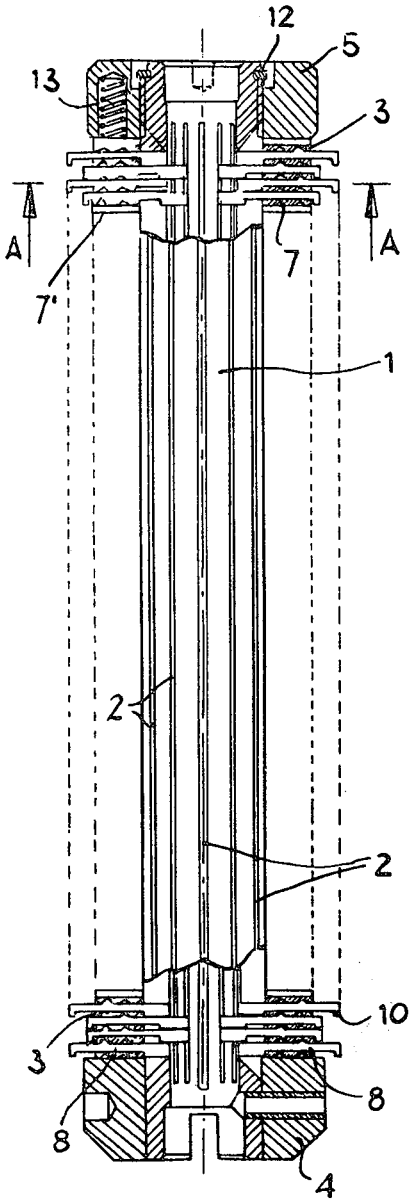
FIG. 1 is a partially cross-sectional assembly view of the pattern drum of the invention with some of the radial fingers shown in operationally active position and others in operationally inactive position.
Figure 3:
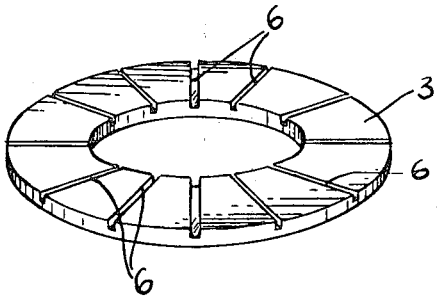
Figure 2:
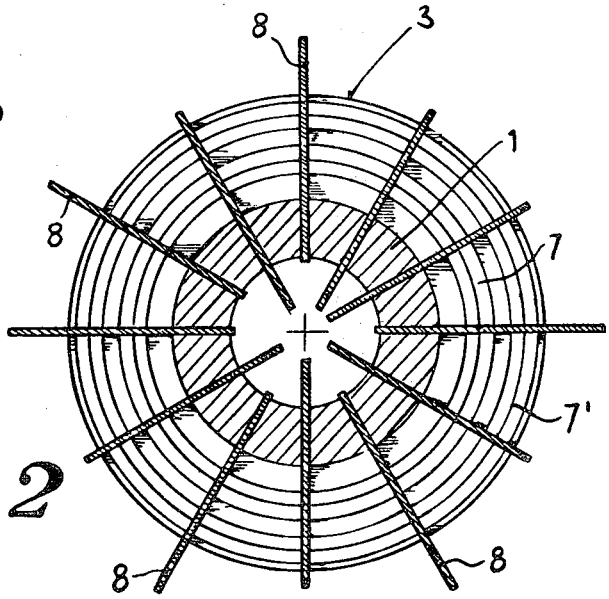
FIG. 2 is an enlarged transverse sectional view of FIG. 1 taken in the direction of the arrows A—A.

With reference to the accompanying drawings, the pattern drum comprises a tubular body 1 having thereon a number of longitudinal grooves 2 circumferentially radially spaced from one another. On the body 1 there is mounted, without possibility of rotation, a plurality of discs 3 superimposed to one another and held in place by two terminal fasteners, e.g. ferrules 4, 5 fixed to the body 1. Each disc 3 contains on one surface thereof a number of radial slots 6 aligned with the longitudinal grooves 2, and on the other and opposite surface thereof preferably a pair of V-shaped circular grooves 7, 7' concentric to each other, the function of which will be described hereinafter.

In the preferred embodiment, the discs 3 are so superimposed to one another that the surface of each disc having the slots 6 thereon is positioned adjacent to a surface with the V-shaped grooves 7, 7' of another disc. In each of the radial slots 6 is positioned a plate-like or leaf-like finger 8 which extends also within the corresponding longitudinal groove 2 toward the center portion of the tubular body 1.

Referring particularly to FIGS. 1 and 5, (representing the preferred embodiments) the finger 8 comprises two terminal projections 9 and 10 having the purpose of defining the limits of displacement of the finger in its relationship with, respectively, active and inactive operational positions. The finger 8 has also a V-shaped projection 11 in intermediate said two terminal projections, the projection 11 engaging one or the other of the two concentric grooves 7, 7' of the adjacent disc so as to define the exact position of operation of the finger.

One of the two terminal fasteners (e.g., ferrules) 4, 5 - for example 4 - is fixedly dove-tailed or the like on the body 1, while the other ferrule is removable and preferably threaded on the outer surface of the extremity of the body 1 so as to allow, upon unscrewing, the loosening of its grip on the discs 3 and, conversely, upon screwing, the tightening and blocking of the discs on the body 1. The loosening of the discs is only limited or relative because the unscrewing of the ferrule is restricted by a stop ring 12. This prevents the complete unthreading of the ferrule. Furthermore, between the ferrule 5 and the disc 3 there are provided spring means 13 for the purpose of rendering gradual and resilient the blocking and unblocking of the discs 3.

The leaf-like fingers 8 are positioned on the pattern drum, as hereabove described in accordance with circularly horizontal and vertical alignments. To obtain the fingers' radial positioning in accordance with a variation in the knitting pattern, it is required simply to loosen the threadable ferrule 5 so as to unblock the discs 3 and, then - manually or mechanically - to displace outwardly radially all the fingers 8 so that they become arrested in this protruding position by the projection 11 in the circular groove 7', the fingers being blocked from further displacement by the terminal projection 9 which is called the inner projection.

When all fingers 8 are displaced outwardly, some of them are displaced - manually or mechanically - back toward the center, while others are left in their protruding position, in accordance with the new design to be knitted.

The projections protruding from the radial grooves 6 are the active ones and are the ones which, similarly to the jacks of the referenced U.S. patent, cooperate with the conventional sliding elements 24 of the jacks 25 mounted on the drum of the circular machine and controlling the needles in the knitting operation.

Conversely, the fingers 8 which are displaced toward the center of the radial grooves are arrested in their displacement by the outer projection 10 against the disc 3 and by the concurrent engagement of the projection 11 in the V-shaped circular groove 7. After the various fingers are positioned, the ferrule 5 is threaded again onto the body 1 so as to block perfectly all the discs 3 and, consequently, all the fingers 8 in their preselected positions.

Substantially, therefore, the positioning of the fingers 8, whenever it is desired to vary the design pattern, is achieved without disassembling and replacing the fingers from the drum as it was the case with heretofore used devices, such as that using lath-like strips or that using peg-like displaceable pins.

Turning to FIG. 6, the control the pattern drum of the invention is achieved by means of a pair of conical gears - right angle drive bevelled gears - 14, 15 of which gears one is dove-tailed or the like to shaft 16 of the pattern drum itself and the other (15) is connected to a horizontal shaft 17 guided within a seat provided in supporting member 18 of the drum proper. On the horizontal shaft 17 there is dove-tailed or the like a disc 19 having frontal pins 19' which are engaged by the noses 20 provided on the conventional sliding element 21 which is, in turn, mounted on and rotating with the support of the cylinder 22 of the machine so as to cause the disc 19 to rotate spurt-like. As disc 9 rotates, so does the conical doublet 14–15 for the rotation of the pattern drum in exact synchronization with the movement of the cylinder of the knitting machine. Sliding member 21 (with its noses 20) is, in turn, positionable in such a way as to determine the selective displacement of the drum in one direction or in the other and by a single step or by two steps each time, in correspondence with the rows of radially available fingers.

The pattern drum comprises, finally means for arresting in the exact position the gear doublet 14–15, these means consisting of a sphere 25' acted upon by a spring 26 provided within the supporting member 18 of the body 1, said sphere always being in engagement with one of the detents 27 appropriately provided on the periphery of the disc 19.

What I claim and wish to secure with Letters Patent of the United States is:

1. Pattern drum for circular knitting and hosiery machines, which comprises:

a. a tubular body having longitudinally superficial grooves therein radially equidistant from one another;

b. a plurality of discs stacked at each terminal of said tubular body and blocked there against by fastening means, each disc having on one surface thereof a number of radial slots aligned with said longitudinal grooves and having on the other surface thereof a pair of circular and concentric notched grooves; and c. a plurality of leaf-like fingers positioned movably within said slots and extending also partially within said longitudinal grooves, said fingers having two terminal projections for defining the limits of displacement and an intermediate, shaped projection to mate with either of said concentric notched grooves.

2. The drum of claim 1, wherein said discs are mounted on said body without possibility of rotation.

3. The drum of claim 1, wherein at least one of said fastening means is partially movable so as to permit the partial unblocking of said discs during the variation of patterns, the extent of displacement of said fastening means being controlled by a thread.

4. The drum of claim 3, wherein spring means are provided between said movable fastening means and the disc adjacent thereto, so as to impart elasticity to the unblocking and blocking operation of the fastening means.

5. The drum of claim 1, wherein said circular grooves and said intermediate projection are V-notched and V-shaped, respectively.

6. The drum of claim 1 in combination with means for the spurt-like rotation of said drum, said means comprising a pair of right-angle bevelled gears, one of said gears connected to said tubular body and the other to a support member thereof, a disc on said other gear with frontal pins thereon for engagement with the mechanism of the cylinder of a circular machine.

* * * * *